US009376239B2

(12) United States Patent
Edamatsu et al.

(10) Patent No.: US 9,376,239 B2
(45) Date of Patent: Jun. 28, 2016

(54) PACKAGE, METHOD FOR MANUFACTURING PACKAGE AND PACKAGED FOOD PRODUCT

(75) Inventors: Toshimitsu Edamatsu, Tokyo (JP); Suzuko Yamato, Tokyo (JP); Kenta Imao, Tokyo (JP)

(73) Assignees: KEWPIE CORPORATION, Tokyo (JP); BESPACK CORPORATION, Tokyo (JP); CARGILL, INCORPORATED, Wayzata, MN (US)

( * ) Notice: Subject to any disclaimer, the term of this patent is extended or adjusted under 35 U.S.C. 154(b) by 14 days.

(21) Appl. No.: 13/985,358

(22) PCT Filed: Feb. 15, 2012

(86) PCT No.: PCT/JP2012/053536

§ 371 (c)(1), (2), (4) Date: Sep. 4, 2013

(87) PCT Pub. No.: WO2012/111708

PCT Pub. Date: Aug. 23, 2012

(65) Prior Publication Data

US 2014/0008397 A1 Jan. 9, 2014

(30) Foreign Application Priority Data

Feb. 18, 2011 (JP) ..... 2011-033792

(51) Int. Cl.

*B65D 35/30* (2006.01)
*B65D 47/10* (2006.01)
*B65D 83/00* (2006.01)
(Continued)

(52) U.S. Cl.

CPC ..... *B65D 35/30* (2013.01); *B05C 17/00583* (2013.01); *B05C 17/00596* (2013.01); *B65D 47/103* (2013.01); *B65D 83/0005* (2013.01); *B05C 17/0123* (2013.01)

(58) Field of Classification Search

USPC ..... 222/325–327, 390–394, 541.1, 541.9
See application file for complete search history.

(56) References Cited

U.S. PATENT DOCUMENTS 2,101,075 A * 12/1937 Krag ..... 222/386
3,323,682 A * 6/1967 Creighton, Jr. et al. ..... 222/94
4,356,935 A * 11/1982 Kamin ..... 222/1
(Continued)

FOREIGN PATENT DOCUMENTS

CN 10188956 A 11/2010
CN 101966743 A 2/2011
(Continued)

OTHER PUBLICATIONS

Machine Translation of FR 2500411.*

*Primary Examiner* — Paul R Durand
*Assistant Examiner* — Vishal Pancholi
(74) *Attorney, Agent, or Firm* — Baker & Hostetler LLP

(57) ABSTRACT

Provided is a pull-top style discharge member for a package to be mounted on a dispenser. The package discharge member is provided with an outer frame 70 having an opening in the center thereof, a cap 71 that closes the opening in the outer frame 70, and can open the opening by being pulled, and a sheet 61 disposed on the reverse surface of the outer frame 70 and the cap 71 and formed with a discharge hole 61*a* in the form of slits to allow passage of food contents. The sheet 61 and the outer frame 70 are welded together, and metallocene polyethylene is used as the material of the outer frame 70, while polypropylene is used as the material of the sheet 61.

8 Claims, 11 Drawing Sheets

(51) Int. Cl.
*B05C 17/005* (2006.01)
*B05C 17/01* (2006.01)

(56) References Cited

U.S. PATENT DOCUMENTS

| | | | | |
|---|---|---|---|---|
| 4,432,473 | A | 2/1984 | MacEwen | |
| 4,830,231 | A | 5/1989 | Smith | |
| 5,653,360 | A * | 8/1997 | Brandhorst et al. | 222/95 |
| 5,993,188 | A * | 11/1999 | Mak | 425/376.1 |
| 6,192,797 | B1 * | 2/2001 | Rea et al. | 101/202 |
| 6,655,554 | B2 * | 12/2003 | Pantelleria et al. | 222/327 |
| 2001/0042757 | A1 * | 11/2001 | Kuge et al. | 222/95 |
| 2002/0190084 | A1 * | 12/2002 | Ichikawa et al. | 222/327 |
| 2003/0183639 | A1 * | 10/2003 | Winckels | 220/666 |
| 2008/0245823 | A1 * | 10/2008 | de Oliveira et al. | 222/327 |
| 2009/0039112 | A1 * | 2/2009 | Robertson et al. | 222/326 |
| 2011/0121028 | A1 * | 5/2011 | Rusch | 222/96 |

FOREIGN PATENT DOCUMENTS

| | | | |
|---|---|---|---|
| FR | 2500411 | A1 | 8/1982 |
| JP | 323436 | B2 | 3/1991 |
| JP | H03-23436 | B2 | 3/1991 |
| JP | 794266 | A | 4/1995 |
| JP | H07-94266 | B2 | 10/1995 |
| JP | 2008307880 | A | 12/2008 |
| JP | 2010105698 | A | 5/2010 |

* cited by examiner

Fig.10

| | Comparative Example 1 | Comparative Example 2 | Comparative Example 3 | Comparative Example 4 | Comparative Example 5 | Comparative Example 6 | Example |
|---|---|---|---|---|---|---|---|
| Cap material | LDPE | LDPE | LDPE | LDPE | LDPE | LDPE | LDPE |
| Outer frame material | PP | PP 80% PE 20% | PP 70% PE 30% | PP 60% PE 40% | LDPE | HDPE | Metallocene PE |
| Sheet material | PP | PP | PP | PP | PP | PP | PP |
| Adhesiveness between outer frame and sheet | (A) | (A) | (B) | (D) | (D) | (D) | (A) |
| Adhesiveness between outer frame and cap | (D) | (D) | (D) | (B) | (A) | (A) | (A) |
| Pull-top seal release | (A) | (A) | (A) | (A) | (A) | (A) | (A) |

| | | | | | | | | |
|---|---|---|---|---|---|---|---|---|
| Drop test | (C) | (B) | (B) | (A) | (A) | (A) | (A) | (A) |
| Penetrant check | (C) | (B) | (B) | (A) | (A) | (A) | (A) | (A) |
| Shape check | (C) | (B) | (A) | (A) | (A) | (A) | (A) | (B) |
| Tensile strength N/15 mm | 3 | 6 | 15 | 23 | 35 | 55 | 80 | 100 |
| Tensile test | (D) | (C) | (B) | (A) | (A) | (A) | (A) | (A) |
| Comprehensive evaluation | (D) | (C) | (B) | (A) | (A) | (A) | (A) | (B) |

PACKAGE, METHOD FOR MANUFACTURING PACKAGE AND PACKAGED FOOD PRODUCT

FIELD OF THE INVENTION

The present invention relates to a package discharge member used for discharging food contents and provided at the end of a package capable of holding food contents and of being mounted on a dispenser for extruding food contents, to a manufacturing method therefor, to a package and to a packaged food product.

BACKGROUND ART

When serving viscous food contents such as mayonnaise and tartar sauce on buns and the like, dispensers are used that extrude specified quantities of these food contents.

A deformable package containing the food contents is mounted on the dispenser, and the dispenser extrudes the food contents by means of a piston that pushes on this package.

Such a package has a framed discharge spout formed at one end, and this discharge spout is provided with a sheet having a discharge hole formed therein. This discharge hole is sealed with a seal that is pasted over the outer surface of the sheet and peeled off when the package is used. At the beginning of use, the seal is peeled off, the other end of the package is pushed with the piston to deform the package, and the contents are extruded through the discharge hole in the sheet (See Patent Documents 1 and 2).

PATENT DOCUMENTS

[Patent Document 1] Japanese Patent Publication No. H07-94266

[Patent Document 2] Japanese Patent Publication No. H03-23436

DISCLOSURE OF THE INVENTION

Problem to be Solved by the Invention

However, when a peelable seal is affixed to a sheet as described above, the seal may peel slightly for example, exposing the contents of the package to the outside air, or causing the contents to leak through the discharge hole of the package. In this case, the contents may be altered by the outside air, or the package may be soiled by the contents.

One possibility would be to adopt a so-called pull-top package discharge member, in which the discharge hole of the sheet is exposed when a cap is pulled off. The sealing properties of the sheet can be improved in this way because the discharge hole of the sheet is closed securely by the cap. Specifically, this could be a package discharge member including an outer frame having an opening in the center thereof, a cap that closes the opening in the outer frame, and can open the opening by being pulled, and a sheet disposed on the reverse surface of the aforementioned outer frame and cap and formed with a discharge hole in the form of slits to allow passage of the food contents.

However, the sheet in this case must have a certain degree of hardness so that the discharge hole can be formed therein. If the sheet is soft, the discharge hole may be deformed by use, and the contents may not be dispensed in the specified amount. It is therefore desirable to use polypropylene as the material of the sheet. The sheet must be fixed to the outer frame, preferably by welding. For this reason, polypropylene is normally selected as the material of the outer frame as it is for the sheet. However, polypropylene is stiff, cracks easily at low temperatures, and is not sufficiently soft for use in the outer frame. Moreover, because the deformable tube attached to the outer frame is formed of a multilayer film and the innermost layer thereof is made of the same polypropylene material as the outer frame, the drop impact strength of the viscous package as a whole is affected. There have been many such issues involved with using polypropylene as the material of the outer frame. Thus, there are problems that need to be solved in order to specifically achieve a so-called pull-top package discharge member.

It is an object of the present invention, which was developed in light of these matters, to provide a package discharge member whereby these problems can be solved, along with a method of manufacturing a package discharge member, a package, and a packaged food product.

Means for Solving the Problem

In order to achieve this object, the present invention is a discharge member used for discharging food contents and provided at the end of a package capable of holding food contents and of being mounted on a dispenser for extruding food contents, the discharge member including: an outer frame having an opening in the center thereof; a cap that closes the opening in the outer frame, and can open the opening by being pulled; and a sheet disposed on the reverse surface of the outer frame and the cap and formed with a discharge hole in the form of slits to allow passage of the food contents, wherein the sheet and the outer frame are welded together, and metallocene polyethylene is used as the material of the outer frame, while polypropylene is used as the material of the sheet. The term "welded" here means that the heat-melted material of the outer frame is effectively bonded to the polypropylene sheet.

The present invention was arrived at based on the discovery that while in general the different materials polyethylene and polypropylene cannot be successfully welded together, if the material of the outer frame is metallocene polyethylene, the outer frame and sheet can be effectively welded together even if the sheet is made of polypropylene. With the present invention, the sheet and outer frame can be effectively welded together while maintaining the hardness of the sheet by using polypropylene as the material of the sheet, and maintaining the softness of the outer frame by using metallocene polyethylene as the material of the outer frame. A pull-top style package discharge member can thus be achieved.

In this package discharge member, the outer frame and the cap are welded, and polyethylene may be used as the material of the cap. In this case, because the cap is of the same material as the outer frame it can be welded to the outer frame, ensuring a seal between the cap and the outer frame. Because the cap is of a different material from the sheet, moreover, it does not weld to the sheet, and the cap can be removed from the sheet without deforming the discharge holes in the sheet.

Another aspect of the present invention provides a method for manufacturing a package discharge member used for discharging food contents and provided at the end of a package capable of holding food contents and of being mounted on a dispenser for extruding food contents, the method including a first step of injection molding an outer frame having an opening for a cap on a sheet formed with a discharge hole in the form of slits to allow passage of the food contents, and a second step of injection molding, on the sheet, the cap whereby the opening in the outer frame can be opened, wherein molding in the first and second steps is continuous two-color injection molding in which the sheet is mounted in a mold, and an upper mold part is replaced while the sheet is held in a same lower mold part, and metallocene polyethylene is used as the material of the outer frame, while polypropylene is used as the material of the sheet.

In the present invention, the sheet and outer frame can be suitably welded by injection molding while ensuring the hardness of the sheet by using polypropylene as the material of the sheet and ensuring the hardness of the outer frame by using metallocene polyethylene as the material of the outer frame. A pull-top style package discharge member is thus achieved. Because molding in the first and second steps is by continuous two-color injection molding with the sheet held in the same lower mold part, it is easy to control the temperature during injection molding in the first and second steps. Since the welding properties between the sheet and outer frame and between the cap and the outer frame are temperature dependent, controlling the temperature makes it easier to control the welding strength. Because the sheet is held in the same lower mold part, moreover, warpage of the sheet due to heat can be prevented because there is no temperature change such as occurs when the sheet is transferred to a separate mold for example. If the mold is changed it may be necessary to let the sheet rest for a certain amount of time in order to stabilize its temperature, but because the mold is the same in this case there is no need for a rest time, which is advantageous for improving hygiene and shortening the manufacturing time of the package discharge member.

In the method for manufacturing a package discharge member, polyethylene may be used as the material of the cap. Molding in the first step may also be performed at an injection molding temperature of 180° C. to 250° C.

Another aspect of the present invention is a package having the aforementioned package discharge member and a deformable tube connected to the outer frame of the discharge member, wherein the tube is formed of a multilayer film, and polyethylene is used as the material of an innermost layer of the multilayer film. In this case, the tube can be welded to the outer frame. This also makes the tube more flexible and gives it greater drop impact strength, so that the food contents in the package can be better extruded by the dispenser.

Another aspect of the present invention is a packaged food product comprising a viscous food product packed and sealed in the aforementioned package.

Effects of the Invention

A pull-top package discharge member is achieved with the present invention, allowing a desired amount of a food contents to be stably dispensed by a dispenser.

BRIEF DESCRIPTION OF THE DRAWINGS

FIG. 10 is a table showing test results for the examples.

MODE FOR CARRYING OUT THE INVENTION

Figure 1:
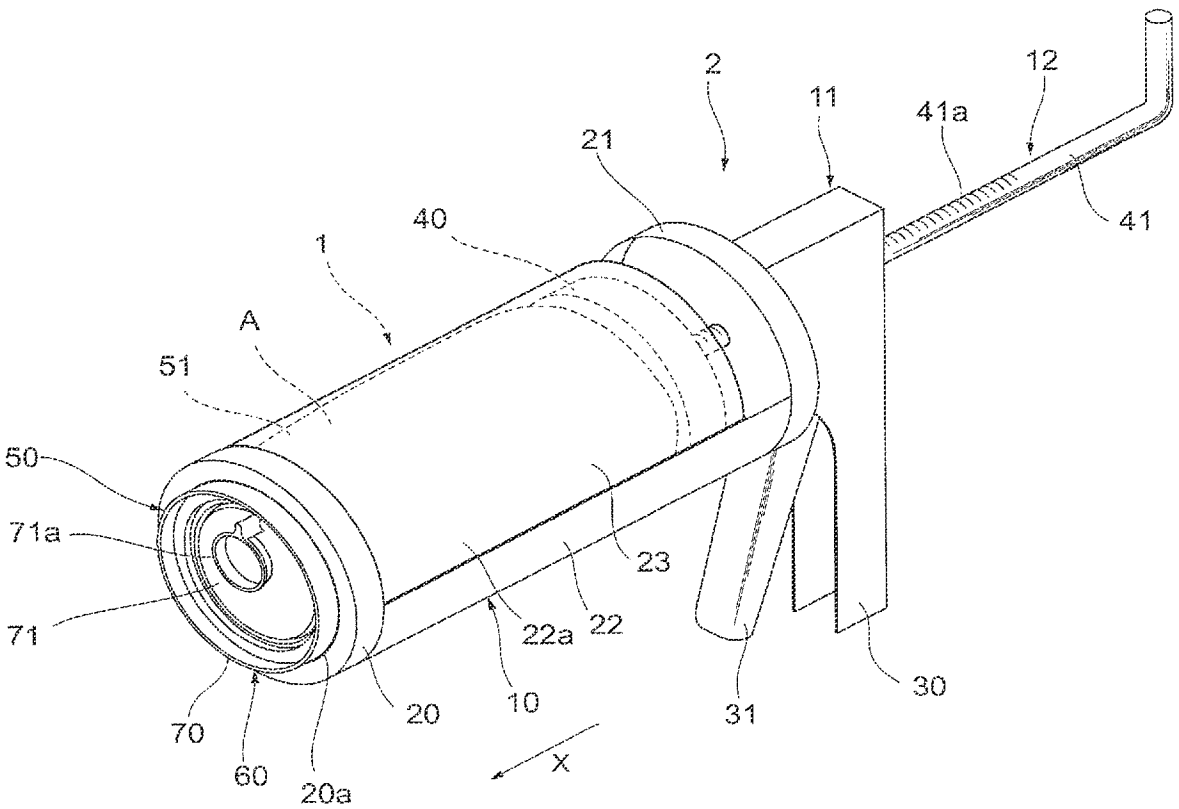
FIG. 1 is an oblique view of a dispenser with a mounted package.

Preferred embodiments of the present invention are explained below with reference to the drawings. FIG. 1 is an oblique view showing the general configuration of dispenser 2 on which is mounted package 1 having a discharge member of this embodiment.

Dispenser 2 has roughly cylindrical package holder 10, handle part 11 attached to the posterior end of this package holder 10, and extrusion member 12, which pushes package 1 in package holder 10 from the back to thereby extrude the contents A of package 1 from the anterior end of package holder 10. Package 1 contains, as food contents A, a viscous food material such as mayonnaise or tartar sauce. The anterior end of dispenser 2 is in the X direction in FIG. 1, while the posterior end is in the reverse direction from the X direction.

Package holder 10 has anterior part 20 having circular opening 20*a* formed as a ring for example in the center, posterior part 21 having rod 41 (described below) running through the center thereof, and roughly cylindrical body 22 connecting front part 20 and posterior part 21. The upper half of body 22 is formed with opening 22*a*. Body 22 contains cylindrical guide 23 for guiding tube 51 (described below) of package 1, which is inserted into the guide. Both ends of guide 23 are open. Guide 23 is formed of resin for example, is separate from package holder 10, and can be removed from package holder 10.

Handle part 11 has for example fixed handle 30 fixed to posterior part 21 of package holder 10, and lever 31 which can move freely with respect to fixed handle 30. A spring (not shown) for example is provided inside handle part 11, so that when the force exerted by pulling lever 31 is released, lever 31 returns to its original position.

Extrusion member 12 has disk-shaped extrusion plate 40 provided inside package holder 10 for example, and rod 41 extending from extrusion plate 40 through posterior part 21 of package holder 10 and handle part 11, out through the back of the dispenser. Multiple grooves 41*a* are formed at fixed intervals in the lengthways direction of rod 41, and lever 31 can be caught on any of grooves 41*a*. This creates a ratchet mechanism whereby when lever 31 caught on any groove 41*a* is pulled, rod 41 is transported forward by the distance between grooves 41*a*, advancing extrusion plate 40, and when lever 31 is released, it catches on the next groove 41*a*. Because there are multiple grooves 41*a*, this operation can be repeated. Lever 31 can be released from groove 41*a* by rotating rod 41 around its axis, and pulled backward.

With this configuration, dispenser 2 can extrude a specific amount of food contents A from package 1 by pulling lever 31 and advancing extrusion plate 40 by a fixed amount to put pressure on package 1, when package 1 is held in package holder 10.

Figure 2:
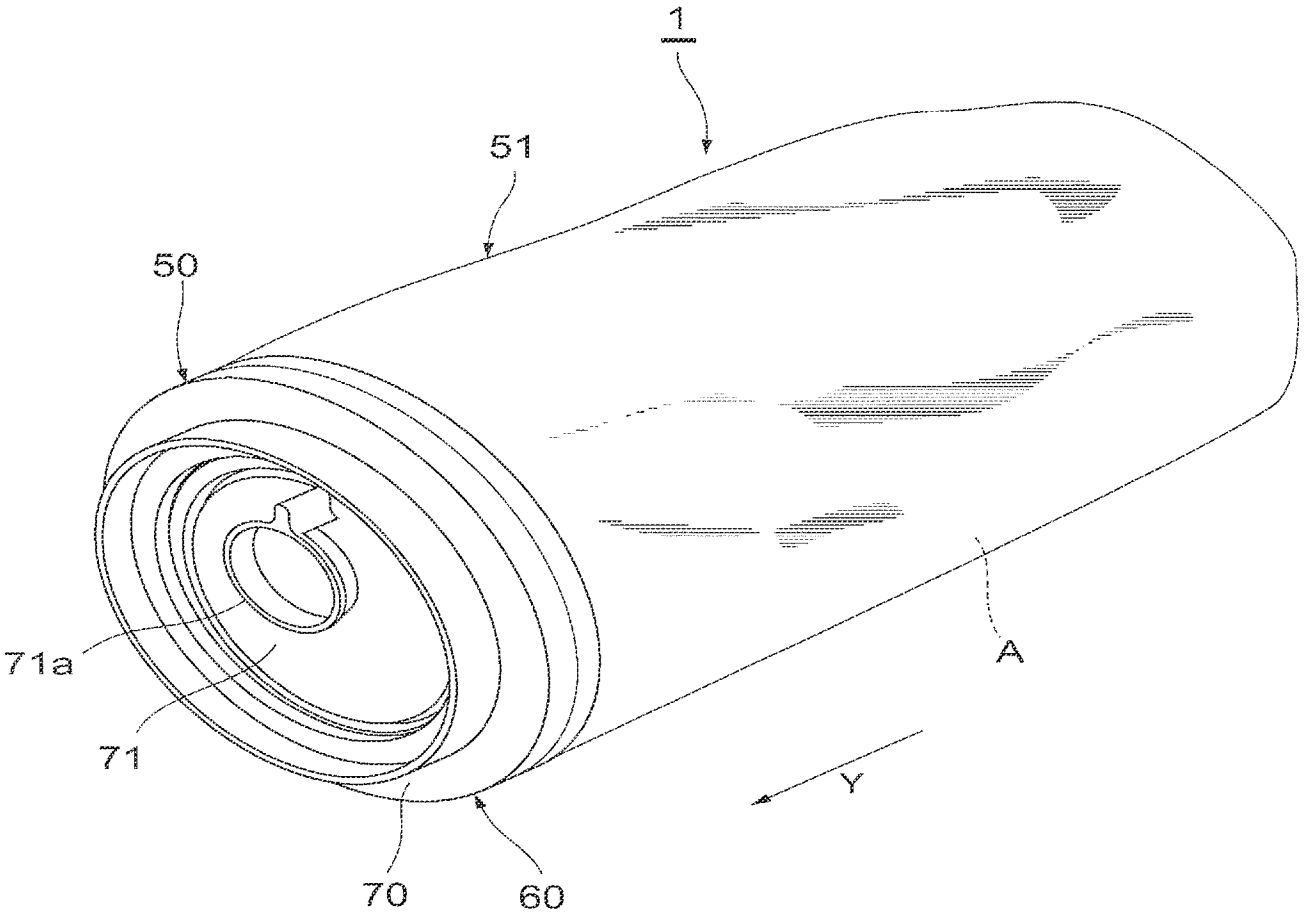
FIG. 2 is an oblique view of a package.

As shown in FIG. 2 for example, package 1 has discharge member 50 at the anterior end of package 1 for discharging food contents A, and deformable tube 51 connected to discharge member 50. The forward (Y direction in FIG. 2) opening of tube 51 is connected to discharge member 50, while the rearward (opposite the Y direction in FIG. 2) opening is sealed to form a bag. Tube 51 is formed of a multilayer film, and the innermost layer thereof is made of polyethylene (PE). A known lamination method such as multilayer coextrusion inflation, extrusion lamination or dry lamination can be used as the method for laminating the multilayer film.

Figure 3:
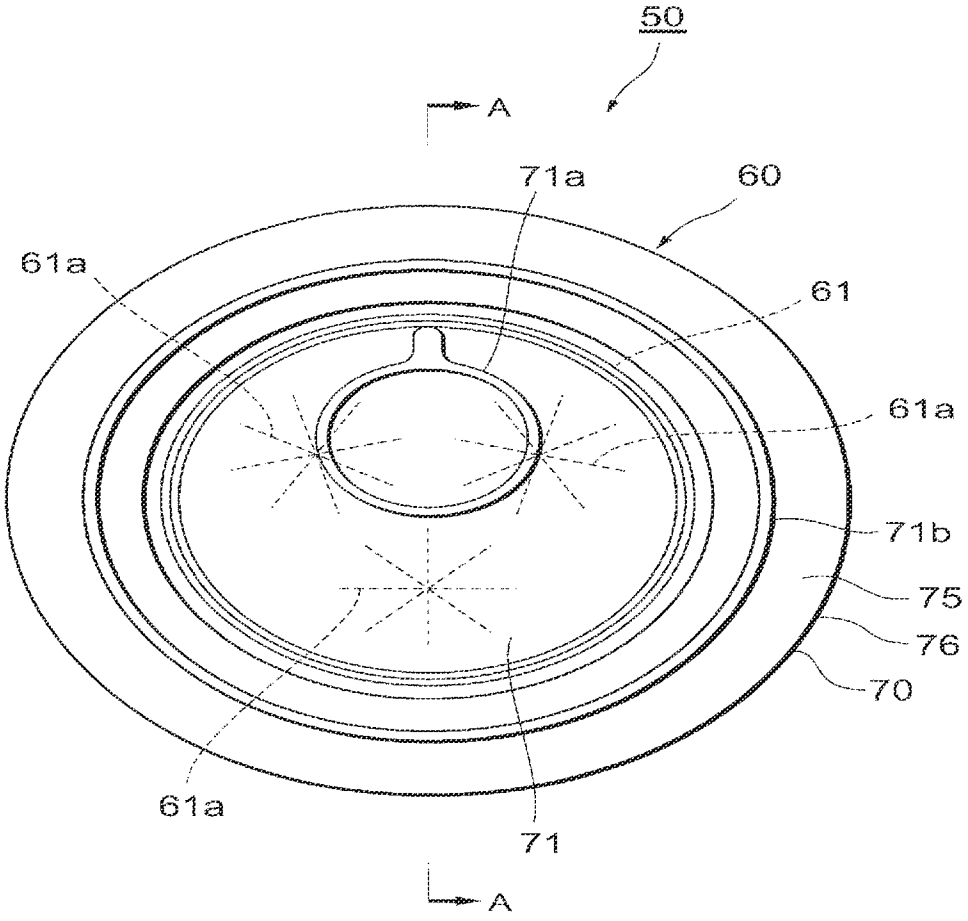
FIG. 3 is a front view of a discharge member.
Figure 4:
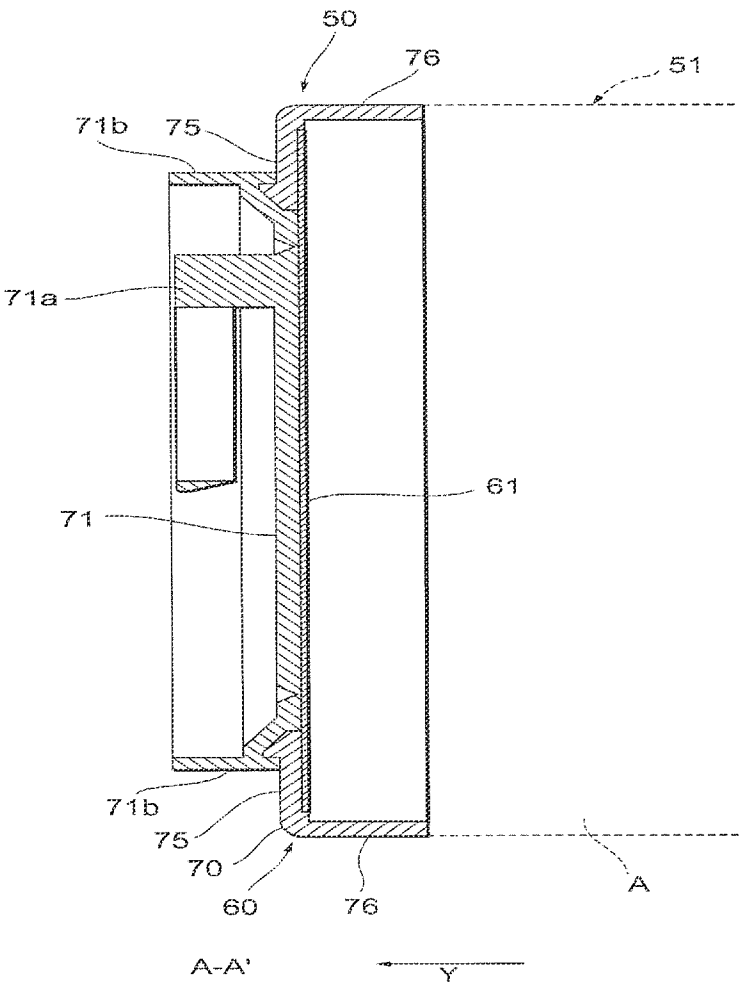
FIG. 4 is an A-A' cross-section of a discharge member.

As shown in FIGS. 3 and 4 for example, discharge member 50 has main body 60 and sheet 61.

Main body 60 has circular outer frame 70 and pull-top cap 71, which can be removed from outer frame 70 to form opening B.

As shown in FIG. 4 for example, outer frame 70 has ring-shaped plate 75 and ring-shaped side wall 76 extending from the outer edge of this plate 75 towards the rear. Tube 51 is attached to the outside of side wall 76 of outer frame 70. Metallocene polyethylene (metallocene PE) prepared (polymerized) using a metallocene catalyst is used as the material of outer frame 70. Types of metallocene PE include metallocene high-density polyethylene (mHDPE) and metallocene linear low-density polyethylene (mLLDPE) for example, and of these, metallocene linear low-density polyethylene is preferred. One kind of metallocene PE may be used alone, or a mixture of two or more kinds may be used. Moreover, as used here a "metallocene PE" may be any consisting primarily of metallocene PE within the scope of general technical common knowledge, and may be a mixture containing polyethylene obtained with a non-metallocene catalyst. A particularly desirable kind of metallocene PE is metallocene linear low-density polyethylene with a density (JIS K 7112) in the range of 0.91 g/cm$^3$ to 0.94 g/cm$^3$ and a softening point of 100° C. to 130° C. Tube 51 is welded to the outside of side wall 76 of outer frame 70.

Cap 71 is formed as a rough disk, and closes the circular opening of plate 75. Cap 71 has removable pull-tab 71*a* and ring-shaped protrusion 71*b*, which is disposed around pull-tab 71*a* extending forwards from plate 75 of outer frame 70. When pull-tab 71*a* of cap 71 is pulled up, pull-tab 71*a* separates from outer frame 70 by means of a pull-top groove provided between pull-tab 71*a* and protrusion 71*b* (leaving circular protrusion 71*b*). Cap 71 is made of a material such as polyethylene (PE) (including LDPE (low-density polyethylene) and HDPE (high-density polyethylene)) for example, and is welded to outer frame 70.

Figure 5:
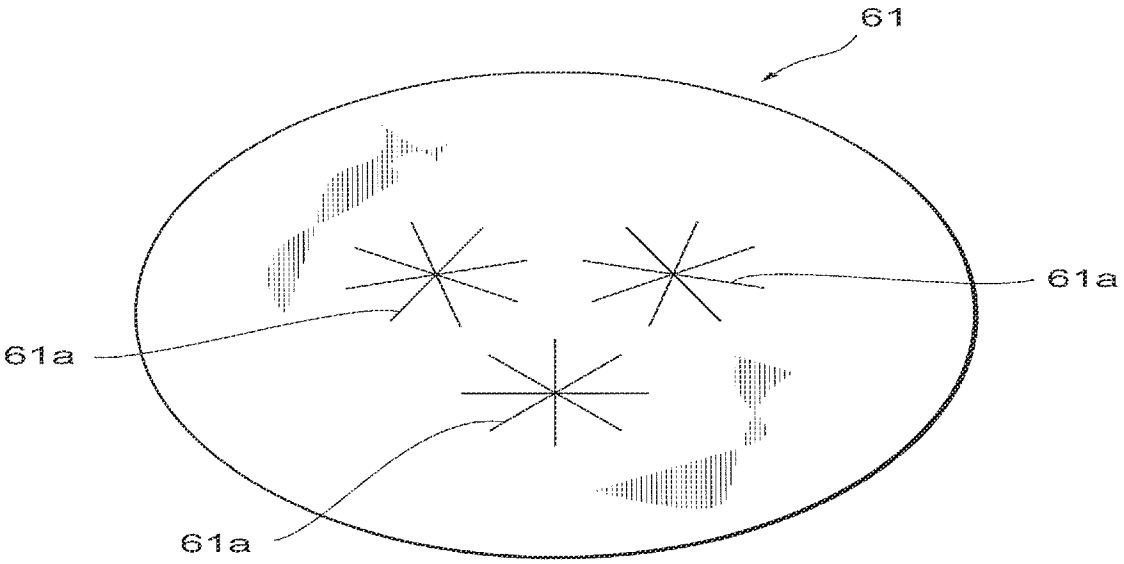
FIG. 5 is a front view of a sheet.

Sheet 61 is in the form of a thin circular membrane as shown in FIG. 5, with discharge holes 61*a* consisting of slits formed at three locations for example. Discharge holes 61*a* may be at any number of locations, however, not just three. The thickness of sheet 61 is preferably selected from 0.2 mm to 0.5 mm considering the function of discharge holes 61*a*.

As shown in FIG. 4, sheet 61 is disposed on the reverse side of outer frame 70 and cap 71. Sheet 61 has a larger diameter than cap 71, and is welded to the reverse side of plate 75 of outer frame 70 so as to cover the reverse surface of cap 71. Polypropylene (PP) is used as the material of sheet 61, which is welded to outer frame 70.

Figure 6:
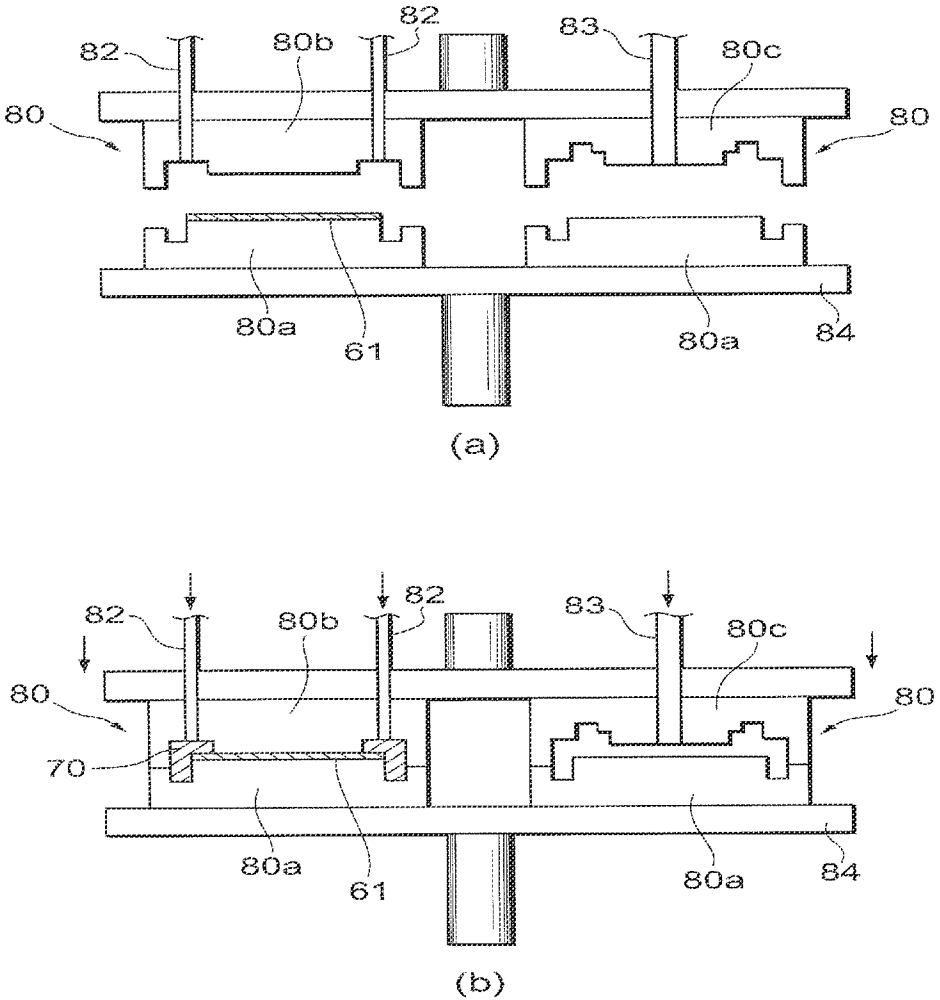
FIG. 6 is an explanatory drawing showing one example of a method of manufacturing a discharge member.
Figure 7:
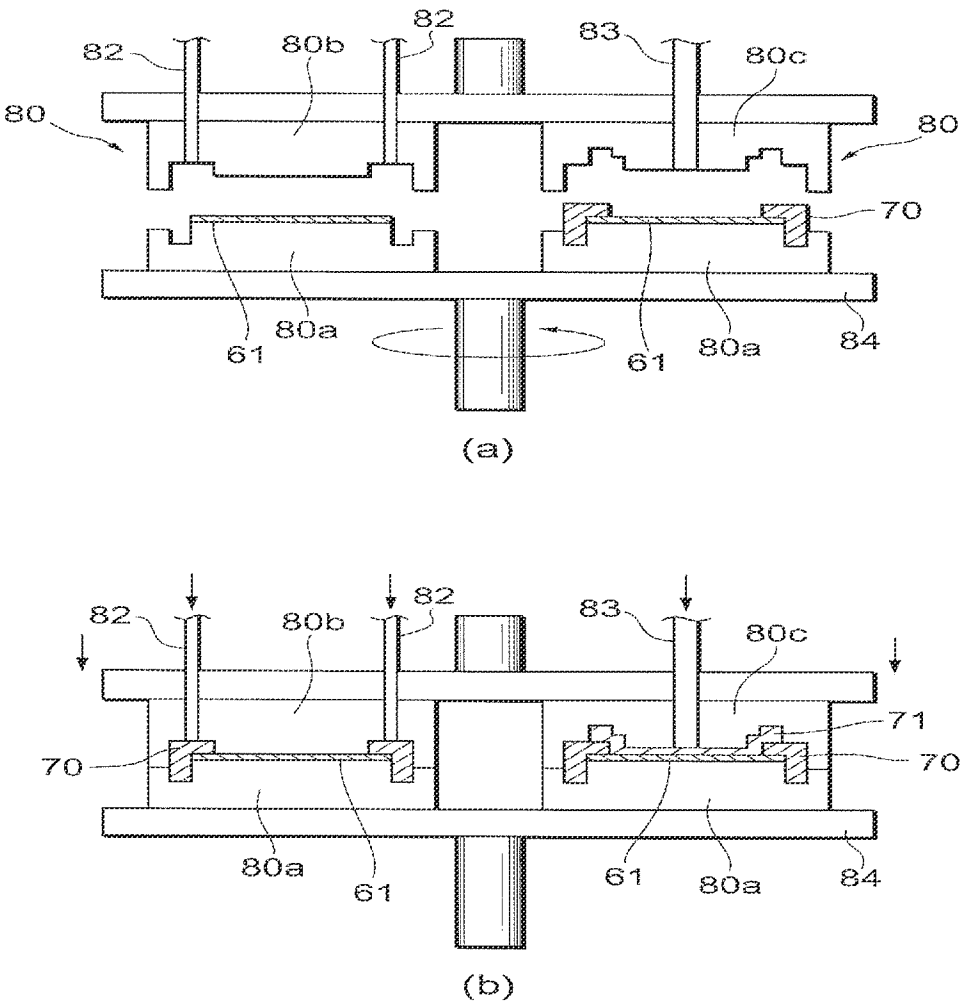
FIG. 7 is an explanatory drawing showing one example of a method of manufacturing a discharge member.
Figure 8:
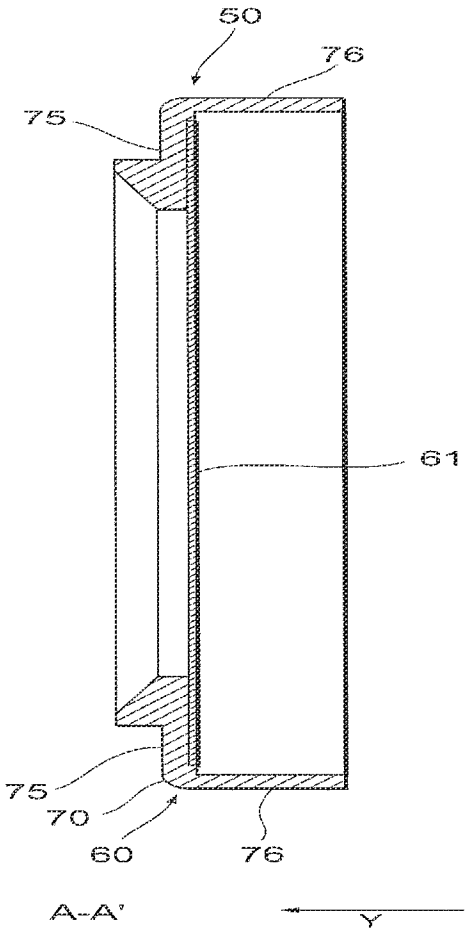
FIG. 8 is a vertical cross-section of a discharge member at the stage of molding the outer frame on the sheet.

Next, the method of manufacturing discharge member 50 is explained. FIGS. 6 and 7 are explanatory drawings illustrating one example of a method for manufacturing discharge member 50. Discharge member 50 is manufactured using a two-color injection molding machine having a pair of injection molds provided on a rotating disk. First, as shown in FIG. 6(*a*), PP sheet 61 is mounted and held on lower mold part 80*a* of mold 80 in the two-color injection molding machine. Next, as shown in FIG. 6(*b*), upper mold part 80*b* for the outer frame is set on lower mold part 80*a*, and metallocene PE heated to a specific temperature is injected as the material of outer frame 70 through nozzles 82 onto sheet 61 in mold 80. The injection molding temperature in this case is 180° C. to 250° C., or preferably 200° C. to 240° C., or more preferably 210° C. to 230° C. Outer frame 70 is thus injection molded (primary molded) on sheet 61 as shown in FIG. 8, and metallocene PE outer frame 70 and PP sheet 61 are welded together.

Next, as shown in FIG. 7(*a*), rotating disk 84 with lower mold parts 80*a* set thereon is rotated 180 degrees, so that lower mold part 80*a* is below upper mold part 80*c* for the cap. In this way, upper mold part 80*b* is replaced by upper mold part 80*c*.

Next, as shown in FIG. 7(*b*), upper mold part 80*c* is set on lower mold part 80*a*, and PE is injected into the cavity as the material of cap 71 from nozzle 83 onto sheet 61 and outer frame 70 in mold 80, with the injection molding temperature either maintained at the temperature set during primary molding, or reduced slightly within the allowable range, for example to 170° C. to 240° C. Cap 71 is thus injection molded (secondary molded) on sheet 61, and the opening in outer frame 70 is thus closed by cap 71 as shown in FIG. 4. PE cap 71 and PP sheet 61 adhere without being welded, while cap 71 and outer frame 70 are welded together. Outer frame 70 and cap 71 are thus molded by two-color injection molding on sheet 61.

Sheet 61 with outer frame 70 and cap 71 molded thereon is then removed from mold 80, completing discharge member 50. While secondary molding is being performed in one lower mold part 80*a* as shown in FIG. 7, primarily molding is performed in the other lower mold part 80*a*. Primary molding and secondary molding are thus performed simultaneously in two molds 80.

Next, tube 51 is welded to the outside of side wall 76 of outer frame 70 of discharge member 50, forming package 1.

Figure 9:
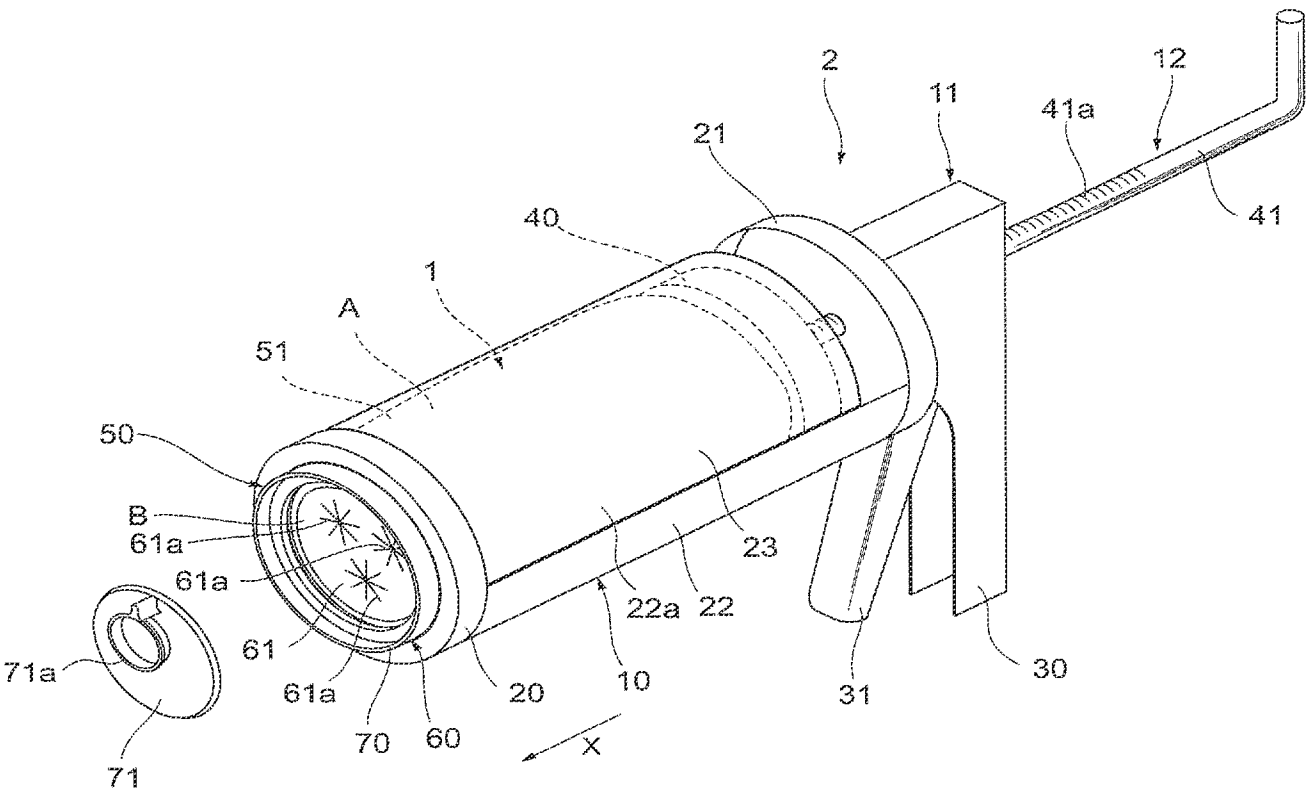
FIG. 9 is an oblique view of a dispenser showing the cap removed from the package.

The operation of using dispenser 2 and package 1 having discharge member 50 configured as explained above to extrude viscous food contents A such as mayonnaise or tartar sauce, onto a hamburger or other food, is explained next. First, food contents A are packaged in tube 51 of package 1 as shown in FIG. 2, and the anterior end of tube 51 is sealed to seal package 1. Next, package 1 is loaded into guide 23, and this guide 23 is mounted inside package holder 10 of dispenser 2 as shown in FIG. 1. At this time, discharge member 50 of package 1 is fitted into anterior part 20 of package holder 10. Next, as shown in FIG. 9, pull tab 71*a* is pulled up to release pull tab 71*a* of cap 71 from discharge member 50, forming opening B in main body 60 and exposing discharge holes 61*a* of sheet 61 through this opening B. Lever 31 of dispenser 2 is then pulled, causing extrusion plate 40 to advance a specific amount and exert pressure from behind on tube 51 of package 1. A specific amount of food contents A are thus extruded through discharge holes 61*a*.

In this embodiment, metallocene PE is used as the material of outer frame 70 while PP is used as the material of sheet 61 based on the finding that the two different materials, PP and metallocene PE, can be effectively welded together. It is thus possible to weld sheet 61 and outer frame 70 while ensuring that sheet 61 is rigid enough to maintain the shape of discharge holes 61*a*, and also ensuring welding strength between outer frame 70 and tube 51. It is thus possible to favorably achieve a package discharge member 50 having a pull-top style cap 71.

Since PE is used as the material of cap 71, moreover, cap 71 can be welded to outer frame 70, which is of the same material, thereby ensuring a seal between cap 71 and outer frame 70. Since cap 71 is not welded to sheet 61, which is of a different material, cap 71 can be removed from sheet 61 without deforming discharge holes 61*a* of sheet 61 when the package is opened.

Since in the method of manufacturing discharge member 50 is by continuous two-color injection molding with sheet 61 retained in the same lower mold part 80*a* of mold 80, moreover, it is easy to control the temperature during injection molding in the primary and secondary molding steps. This makes it easier to control adhesiveness and the like between sheet 61 and outer frame 70 and between cap 71 and outer frame 70, since these are dependent on temperature, so the adhesive strength can be adjusted appropriately. Because sheet 61 is held in the same lower mold part 80*a* of mold 80, moreover, warpage of sheet 61 due to heat can be prevented because there is no temperature change such as would occur if sheet 61 were transferred to a separate mold for example. If the mold wee changed, moreover, it might be necessary to let sheet 61 rest for a certain amount of time in order to stabilize its temperature, but because mold 80 is the same in this case there is no need for a rest time, which is advantageous for improving hygiene and shortening the manufacturing time of package discharge member 50.

In the primary molding step, the temperature for injection molding is 180° C. to 250° C. or preferably 200° C. to 240° C. or ideally 210° C. to 230° C. so as to provide strong adhesiveness between outer frame 70 and sheet 61. Injection molding in the secondary molding step can be performed at a temperature 10° C. to 30° C. lower than that of the primary molding step. Injection molding in the secondary molding step is therefore performed at a temperature of 170° C. to 240° C. for example, or preferably 180° C. to 205° C. or more preferably 180° C. to 200° C. so that the strength of adhesion between cap 71 and sheet 61 can be controlled.

Since the innermost layer of tube 51 of package 1 is made of PE, moreover, the tube can be suitably welded to outer frame 70, which is made of metallocene PE. Tube 51 is also extremely flexible, facilitating extrusion of food contents A from package 1 by means of dispenser 2. Therefore, package 1 of food contents A is ideally suited for dispenser 2 when PP is used as the material of sheet 61, metallocene PE is used as the material of outer frame 70 and PE is used as the material of tube 51 as in this embodiment. Moreover, because a food product packaged and sealed in package 1 is stably and safely discharged, a high-quality food product can be stably manufactured.

A preferred embodiment of the present invention was explained above with reference to the attached drawings, but the present invention is not limited to this example. A person skilled in the art could of course conceive of various modifications and corrections within the scope of the concepts described in the claims, and these are naturally included in the technical scope of the present invention.

For example, in the embodiment above cap 71 was injection molded on sheet 61 in the secondary molding step, but cap 71 could also be injection molded on sheet 61 in the primary molding step, or outer frame 70 could be injection molded on sheet 61 in the secondary molding step. Moreover, dispenser 2 in which the package 1 described in this embodiment is mounted need not necessary be a gun-type dispenser, but may have a different structure.

Example 1

Tests were performed to evaluate the adhesive strength between outer frame 70 and sheet 61 and between outer frame 70 and cap 71 and the openability of cap 71 in the package discharge member. For testing purposes, package discharge members were manufactured using polypropylene as the material of sheet 61, while varying the materials of both outer frame 70 and cap 71, using the two-color injection molding method which is the package discharge member manufacturing method described above.

The test results are shown in the Table of FIG. 10 as Comparative Examples 1 to 6 and Example 1. The examples were graded (A) when optimum adhesiveness and openability were obtained, (B) when usable adhesiveness and openability were obtained, (C) when the adhesiveness and openability could cause some problems during use, and (D) when usable adhesiveness and openability were not obtained.

The tests were performed using a 0.3 mm-thick sheet of PP, with the temperature during molding set to 180° C. to 250° C. in the primary molding step and 170° C. to 240° C. in the secondary molding step. For the test materials, Japan Polyethylene Corp. Novatec LJ802" was used as the LDPE, Japan Polyethylene Corp. Harmorex NJ664N as the metallocene PE, Japan Polypro Corp. Novatec BCO3B as the PP, and Keiyo Polyethylene M6900 as the HDPE.

These tests showed that when cap 71 was made of LDPE and outer frame 70 was made of metallocene PE, good adhesiveness between outer frame 70 and sheet 61, good adhesiveness between outer frame 70 and cap 71, and good openability of cap 71 were obtained.

Test results from an investigation of desirable injection molding temperature (injection molding cylinder temperature) during molding are given next.

In this test, sheet 61 was made of polypropylene, this sheet 61 was mounted in a specific position on the movable part of the mold, and outer frame 70 was primary molded out of a different material, metallocene polyethylene. When the injection molding temperature for primary injection molding was varied from 180° C. to 250° C., the conditions were consistent with the test results given above, indicating that polypropylene and metallocene polyethylene can be effectively welded at temperatures of 180° C. to 250° C.

More detailed conditions with respect to injection molding temperatures are as follows.

(1) When the injection molding temperature was 180° C. or 190° C., welding between the sheet and outer frame was weak.

(2) When the injection molding temperature was 200° C., welding between the sheet and outer frame was better but not strong.

(3) When the injection molding temperature was 210° C. or 220° C., the sheet and outer frame were strongly welded together.

(4) When the injection molding temperature was 230° C. or 240° C., the sheet and outer frame were welded together even more strongly.

(5) When the injection molding temperature was 250° C. or more, the sheet and outer frame were strongly welded together, but sink marks and warpage were more likely, leading to molding defects.

Thus, the injection molding temperature for primary molding is preferably 200° C. to 240° C., or more preferably 210° C. to 230° C.

After primary molding the mold was opened, the primary-molded outer frame of the discharge member was left in the movable part of the mold, and the rotating mold disk was rotated 180° C. by a rotational mechanism, transferring this mold to the secondary molding cavity, after which LDPE was injected under pressure into the cavity for pull-top cap 71, forming the cap as a unit with the outer frame of the discharge member. The injection molding temperature during secondary molding can be set 10° C. to 30° C. lower than the temperature for primary molding. Consequently, secondary molding is performed at an injection molding temperature of 170° C. to 240° C. or preferably 180° C. to 205° C. or more preferably 180° C. to 200° C., so that the degree of adhesion between cap 71 and sheet 61 can be controlled. Setting the secondary molding temperature 10° C. to 30° C. lower than the temperature for primary molding makes it easier to control bonding between the cap and the sheet.

Example 2

Tests to evaluate the strength of adhesion and sealing performance between outer frame 70 and sheet 61 were performed on the package discharge member. For the tests, a polypropylene sheet with a thickness of 0.3 mm (in the range of 0.2 mm to 0.5 mm) was used for sheet 61, the metallocene PE material of outer frame 70 was heated and melted and insert molded by injecting it into the cavity of a mold on sheet 61, and the strength of adhesion and sealing performance between sheet 61 and outer frame 70 were measured.

Examples of the polypropylene of sheet 61 include those shown in Table 1 below.

TABLE 1

| Manufacturer | Grade |
|---|---|
| I'SHEET ind. Corp | PP #3000 Series |
| SEKISUI SEIKEI Co., Ltd. | Sekisui Polysame |
| Sheedom Co., Ltd | PPS Series, Aqua Series |
| Okamoto Industries, Inc. | Okamoto PP Sheet |
| KYOEI JUSHI Corporation | Kyoei PP Sheet |
| OJK Inc. | Orphan PP Sheet |
| Idemitsu Unitech Co., Ltd. | Multilay PNP Type |
| SANVIC Inc. | Hipearl PP Sheet |
| NISSEN POLYTEC CORPORATION | U-Sheet PP |

Examples of the metallocene PE of outer frame 70 include those shown in Table 2 below.

TABLE 2

| Manufacturer | Product | Grade | Density (g/cm$^3$) | MFR (g/10 min) | Vicat softening point |
|---|---|---|---|---|---|
| Japan Polyethylene Corporation | Harmorex | NJ664N | 0.919 | 8 | 100° C. |
| Japan Polyethylene Corporation | Harmorex | NJ744N | 0.911 | 12 | 90° C. |
| UBE-MARUZEN POLYETHLENE | Umerit | 631J | 0.931 | 20 | 107° C. |
| UBE-MARUZEN POLYETHLENE | Umerit | 613A | 0.913 | 30 | 83° C. |

0.3 mm was used as the thickness of sheet 61, but a thickness that allows the discharge holes 61*a* of sheet 61 to function as valves may be selected appropriately. Moreover, one of the resins described in Table 2 may be selected as the metallocene PE of outer frame 70, or a blend may be used.

Figures 11, 12:
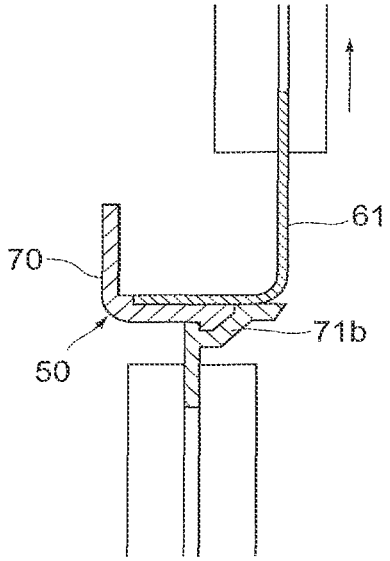
FIG. 11 is a table showing the welding test results of the examples.
FIG. 12 is an explanatory drawing illustrating a method of measuring tensile strength.

The following four tests were performed as tests to evaluate strength of adhesion and sealing performance. The test results are shown in the table of FIG. 11.

(Test 1: Drop Test)

In Test 1, multiple discharge members 50 were prepared so as to give different strengths of adhesion (welding) between PP sheet 61 and metallocene PE outer frame 70. Nylon/polyethylene tubes 51 with a flat width of 120 mm and a length of 200 mm were welded to these discharge members 50, and the tubes 51 were each filled with 700 g of water, and then sealed so as to forcibly exclude all air from the tubes and prepare samples of package 1. The water-filled packages 1 were subjected to a drop test in which they were dropped onto a hard concrete or other floor from a height of 90 cm. They were then rated as (A) if optimal adhesiveness was obtained with absolutely no water leakage, (B) if useful adhesiveness was obtained with no evident water leakage, (C) if the adhesiveness was such as might cause some problems for use, and (D) if there was any water leakage and usable adhesiveness was not obtained.

(Test 2: Penetrant Check)

In Test 2, the site of adhesion of sheet 61 and outer frame 70 of those packages 1 that were evaluated as (A), (B) or (C) in the drop test was painted with a red penetrant and left for 30 minutes, and penetration of the weld between sheet 61 and outer frame 70 by the red penetrant was confirmed. This was then confirmed again 24 hours later. Ageless seal check spray from MITSUBISHI GAS CHEMICAL COMPANY, INC. was used as the penetrant spray. The rating was (A) if optimal adhesiveness was obtained with absolutely no intrusion of penetrant into the weld, (B) if usable adhesiveness was obtained with no intrusion of penetrant into the weld, (C) if the adhesiveness was such as might cause some problems for use, and (D) if usable adhesiveness was not obtained.

(Test 3: Weld Strength Tensile Test)

In Test 3, 20 discharge members 50 are prepared under the same conditions as those packages 1 that were rated (A), (B) or (C) in the drop test, the discharge members 50 are held upside-down in a tensile tester as shown in FIG. 12, and sheets 61 cut in 15 mm-wide strips are pulled upward at specific sites on the welded part. Sheets 61 were pulled until the weld between sheet 61 and outer frame 70 was peeled from 0% up to 50% to 80% of the weld width, and the maximum value was given as the tensile strength. The reason why 100% of the weld width was not used was to eliminate the values in cases when part of the welded part remained.

The values for tensile strength in FIG. 11 are averages calculated from the test results for 20 discharge members 50. The rating was (A) if optimal adhesiveness and sealing performance were obtained, (B) if usable adhesiveness and sealing performance were obtained, (C) if the adhesiveness and sealing performance were such as might cause some problems for use, and (D) if usable adhesiveness and sealing performance were not obtained.

Test equipment: Orientech Tensilon RTC-1225

Test method: T-peel strength test

Test speed: 50 mm/min (Test 4: Visual Shape Check)

In Test 4, the molding condition of discharge members 50 (sink marks, liquid flow, etc.) was confirmed visually. The rating was (A) if an optimal molded state was obtained with no sink marks or the like, (B) if a usable molded state was obtained, (C) if the molded was such as might cause some problems for use, and (D) if a usable molded state was not obtained.

Desirable welding conditions for welding PP sheet 61 and metallocene PE outer frame 70 were selected based on the results of the drop test, penetrant check, tensile strength test and visual shape check above. Looking closely at the test results as shown in FIG. 11, in the drop test of Test 1 those with a tensile strength of 3 N/15 mm were usable although with the possibility of some problems for use, while a tensile strength of 6 N/15 mm or more ensured a usable degree of adhesiveness. Optimal results were obtained at a tensile strength of 23 N/15 mm or more. The results of the penetrant check of Test 2 were similar to those of the drop test of Test 1. In the tensile strength test of Test 3, those with a tensile strength of 6 N/15 mm were usable although with the possibility of some problems for use, while at 15 N/15 mm there were no problems for use, and optimal results were obtained with a tensile strength of 23 N/15 mm or more, and there was no upper limit when the numbers were large.

The function of the visual shape check of Test 4 is to check the molding condition (sink marks, warpage, etc.) rather than the strength of adhesion and sealing performance. Those with a tensile strength of 3 N/15 mm were usable although with the possibility of some problems for use, while a tensile strength of 6 N/15 mm or more ensured a usable degree of adhesiveness. Optimal results were obtained with a tensile strength of 15 N/15 mm or more. In contrast to Tests 1 to 3, however, conditions were not optimal when the tensile strength was 100 N/15 mm, and the rating fell to a usable level. This is because if the strength is made too great when evaluating strength of adhesion and sealing performance, sink marks, warpage and the like occur, resulting in a poor evaluation. Therefore, the comprehensive judgment was that a tensile strength of 6 N/15 mm or more was usable, but a range of 15 N/15 mm or more was preferred from the standpoint of strength of adhesion and sealing performance. The upper limit in this case cannot be specified. However, since the rating suffered when the tensile strength was 100 N/15 mm in the visual shape test of Test 4, a tensile strength of 100 N/15 mm or more may not be desirable. From the standpoint of welding conditions, a preferred range of tensile strength is 15 N/15 mm to 100 N/15 mm.

Even if there are changes in resin lot, resin manufacturer, product number or the like, it is possible to provide a discharge member 51 having the function of package 1 at a fixed level. Since welding can be accomplished reliably if the same material is selected for outer frame 70 and tube 51, it is possible to ensure drop strength by selecting a composite resin as the material of tube 51.

INDUSTRIAL APPLICABILITY

With the present invention, a package discharge member for mounting on a dispenser is useful for stably discharging a desired quantity of food contents.

EXPLANATION OF REFERENCE NUMERALS

1 Package
2 Dispenser
50 Discharge member
60 Main body
61 Sheet
61*a* Discharge hole
70 Outer frame
71 Cap
80 Mold
80*a* Lower mold part
A Food contents
B Opening

The invention claimed is:

1. A package capable of being mounted on a dispenser for extruding food contents, the package comprising:

a package discharge member for discharging food contents, the package discharge member being provided at an end of the package, and a deformable tube capable of holding food contents, wherein the package discharge member comprises:

an outer frame having an opening in the center thereof;

a polyethylene cap welded to the outer frame, that closes the opening in the outer frame, and can open the opening by being pulled; and a sheet disposed on a reverse surface of the outer frame and the polyethylene cap, the sheet abutting a reverse surface of the polyethylene cap and formed with a discharge hole in the form of slits to allow passage of the food contents, wherein the sheet and the outer frame are welded together, metallocene polyethylene is used as a material of the outer frame, and polypropylene is used as a material of the sheet, the deformable tube has an inner side face made of polyethylene, and the inner side face of the deformable tube is welded to an outer side face of the outer frame.

2. The package according to claim 1, wherein the deformable tube is formed of a multilayer film, and polyethylene is used as a material of an innermost layer of the multilayer film.

3. A packaged food product comprising a viscous food product packed and sealed in the package according to claim 2.

4. The package according to claim 1, wherein the outer frame has a ring-shaped plate and a ring-shaped side wall extending from an outer edge of the ring-shaped plate toward a rear portion of the outer frame.

5. The package according to claim 4, wherein the cap has a removable pull-tab and a ring-shaped protrusion, and the ring-shaped protrusion is disposed around the pull-tab and extends forward from the plate of the outer frame.

6. The package according to claim 4, wherein the sheet has a larger diameter than the cap and is welded to a reverse side of the plate of the outer frame so as to cover the reverse surface of the cap.

7. The package according to claim 1, wherein the thickness of the sheet is from 0.2 mm to 0.5 mm, inclusive.

8. The package according to claim 1, wherein the metallocene polyethylene is metallocene linear low-density polyethylene with a density (JIS K 7112) in the range of from 0.91 $g/cm^3$ to 0.94 $g/cm^3$, inclusive, and a softening point of from 100° C. to 130° C., inclusive.

* * * * *